US008474888B2

(12) United States Patent
Tomaszewski

(10) Patent No.: US 8,474,888 B2
(45) Date of Patent: Jul. 2, 2013

(54) CLOSURE LATCH FOR VEHICLE DOOR

(75) Inventor: Kris Tomaszewski, Newmarket (CA)

(73) Assignee: Magna Closures Inc., Newmarket (CA)

( * ) Notice: Subject to any disclaimer, the term of this patent is extended or adjusted under 35 U.S.C. 154(b) by 353 days.

(21) Appl. No.: 12/731,353

(22) Filed: Mar. 25, 2010

(65) Prior Publication Data

US 2010/0244466 A1 Sep. 30, 2010

Related U.S. Application Data

(60) Provisional application No. 61/163,281, filed on Mar. 25, 2009, provisional application No. 61/163,471, filed on Mar. 26, 2009.

(51) Int. Cl.
*E05C 3/06* (2006.01)

(52) U.S. Cl.
USPC ..... 292/201; 292/216

(58) Field of Classification Search
USPC ..... 292/201, 216
See application file for complete search history.

(56) References Cited

U.S. PATENT DOCUMENTS 4,298,223 A * 11/1981 Raffelsiefer et al. ..... 292/216
4,814,557 A * 3/1989 Kato ..... 200/61.64
4,929,007 A * 5/1990 Bartczak et al. ..... 292/336.3
5,020,838 A * 6/1991 Fukumoto ..... 292/201
5,618,068 A * 4/1997 Mitsui et al. ..... 292/201
5,642,636 A * 7/1997 Mitsui ..... 70/237
5,697,237 A * 12/1997 Dilger et al. ..... 70/264
5,762,383 A * 6/1998 Gomi ..... 292/216
5,765,884 A * 6/1998 Armbruster ..... 292/216
5,802,894 A * 9/1998 Jahrsetz et al. ..... 70/264
5,876,074 A * 3/1999 Dowling ..... 292/201
5,934,717 A * 8/1999 Wirths et al. ..... 292/201
6,003,910 A * 12/1999 Dupont et al. ..... 292/201
6,010,165 A * 1/2000 Santarelli et al. ..... 292/216
6,053,543 A * 4/2000 Arabia et al. ..... 292/201
6,155,124 A * 12/2000 Wirths ..... 74/89.13
6,254,148 B1 * 7/2001 Cetnar ..... 292/201
6,382,686 B1 * 5/2002 Ishigaki et al. ..... 292/201
6,386,599 B1 * 5/2002 Chevalier ..... 292/201
6,400,278 B1 * 6/2002 Weyerstall et al. ..... 340/686.3
6,416,088 B1 * 7/2002 Graute ..... 292/216
6,419,286 B1 * 7/2002 Szablewski ..... 292/216
6,439,623 B1 * 8/2002 Lohfeld et al. ..... 292/201

(Continued)

*Primary Examiner* — Carlos Lugo
*Assistant Examiner* — Mark Williams
(74) *Attorney, Agent, or Firm* — Millman IP Inc.

(57) ABSTRACT

A closure latch includes a ratchet movable between an open position and a closed position. A pawl is provided and is movable between a ratchet locking position wherein the pawl holds the ratchet in the closed position and a ratchet release position. An inside door release lever is operatively connectable to the pawl. A lock includes a lock link movable between an unlocked position wherein the lock link operatively connects the inside door release lever to the pawl, and a locked position wherein the inside door release lever operatively disconnects the inside door release lever from the pawl. A lock lever cam rotatable between an unlocking range wherein the lock lever cam permits the lock link to move to the unlocked position, and a locking range wherein the lock lever moves the lock link to the locked position. The lock further includes an override member connected for rotation with the lock lever cam and rotatable between an actuatable range wherein the inside door release lever is engageable with the override member to move the lock lever cam to the unlocking range, and a non-actuatable range wherein the inside door release lever is operatively disconnected from the override member.

10 Claims, 7 Drawing Sheets

U.S. PATENT DOCUMENTS

| | | | | |
|---|---|---|---|---|
| 6,526,790 | B2 * | 3/2003 | Wegner | 70/277 |
| 6,565,131 | B2 * | 5/2003 | Roos | 292/201 |
| 6,575,507 | B2 * | 6/2003 | Reddmann | 292/216 |
| 6,883,839 | B2 * | 4/2005 | Belmond et al. | 292/201 |
| 6,948,745 | B2 * | 9/2005 | Chevalier | 292/201 |
| 7,032,937 | B2 * | 4/2006 | Boecker et al. | 292/201 |
| 7,040,674 | B2 * | 5/2006 | Lomicka et al. | 292/201 |
| 7,059,640 | B2 * | 6/2006 | Tensing et al. | 292/201 |
| 7,234,737 | B2 * | 6/2007 | Kalsi | 292/201 |
| 7,261,333 | B2 * | 8/2007 | Tomaszewski | 292/201 |
| 7,261,334 | B2 * | 8/2007 | Oberheide et al. | 292/201 |
| 7,384,080 | B2 * | 6/2008 | Kachouh | 292/201 |
| 7,789,440 | B2 * | 9/2010 | Graute et al. | 292/216 |
| 2002/0070564 | A1 * | 6/2002 | Ohta et al. | 292/201 |
| 2002/0121784 | A1 * | 9/2002 | Chevalier | 292/201 |
| 2004/0245786 | A1 * | 12/2004 | Hashiba et al. | 292/216 |
| 2005/0001437 | A1 * | 1/2005 | Brose | 292/216 |
| 2005/0200137 | A1 * | 9/2005 | Nelsen et al. | 292/201 |
| 2006/0076784 | A1 * | 4/2006 | Kachouh et al. | 292/216 |
| 2006/0131893 | A1 * | 6/2006 | Tomaszewski | 292/216 |
| 2006/0131894 | A1 * | 6/2006 | Graute | 292/216 |
| 2006/0157989 | A1 * | 7/2006 | Graute | 292/216 |
| 2007/0007774 | A1 * | 1/2007 | Stefanic | 292/216 |
| 2008/0136196 | A1 * | 6/2008 | Pecoul et al. | 292/215 |
| 2008/0203737 | A1 * | 8/2008 | Tomaszewski et al. | 292/216 |
| 2008/0224482 | A1 * | 9/2008 | Cumbo et al. | 292/216 |

* cited by examiner

CLOSURE LATCH FOR VEHICLE DOOR

This application claims the benefits of U.S. Provisional Application No. 61/163,281, filed Mar. 25, 2009 and U.S. Provisional Application No. 61/163,471, filed Mar. 26, 2009.

FIELD OF THE INVENTION

The present invention relates to a closure latch for a vehicle door, and more particularly to a closure latch for a vehicle door equipped with a passive entry feature.

BACKGROUND OF THE INVENTION

Passive entry systems for vehicles are provided on some vehicles to permit a vehicle user who is in possession of the vehicle key to simply pull the door handle and open the door without the need to introduce the key into a keyhole in the door. The key fob is typically equipped with an electronic device that communicates with the vehicle's on-board control system to authenticate the user. When the user pulls the door handle to indicate that he/she wishes entry into the vehicle, he/she pulls the outside door handle and an electric actuator releases the ratchet to open the door. The outside handle is equipped with a switch that triggers the electric actuator. The latch may also be openable mechanically from inside the vehicle since the inside handle is connected to the inside door release lever on the latch. In some jurisdictions, however, there are regulations that govern the degree of connection between the inside door handle and the ratchet from the closure latch (particularly for a rear door, where children may be the occupants). In one aspect, it would be advantageous to provide a closure latch that can be used on a rear door of a vehicle, and that provides electrical release from outside the vehicle (eg. for passive entry) and that provides mechanical release from inside the vehicle.

SUMMARY OF THE INVENTION

In a first aspect, the invention is directed to a closure latch for a vehicle door. The closure latch has a ratchet and a lock that has a double pull override feature, wherein, when the lock is in a locked state, the inside door release lever can be actuated once to unlock the lock and a second time to open the vehicle door.

In a particular embodiment, the closure latch includes a ratchet movable between an open position and a closed position and biased towards the open position. A pawl is provided and is movable between a ratchet locking position wherein the pawl holds the ratchet in the closed position and a ratchet release position wherein the pawl permits the ratchet to move to the open position, and wherein the pawl is biased towards the ratchet locking position. An inside door release lever is operatively connectable to the pawl. A lock includes a lock link movable between an unlocked position wherein the lock link operatively connects the inside door release lever to the pawl, and a locked position wherein the inside door release lever operatively disconnects the inside door release lever from the pawl, wherein the lock link is biased towards the unlocked position. The lock further includes a lock lever cam rotatable between an unlocking range wherein the lock lever cam permits the lock link to move to the unlocked position, and a locking range wherein the lock lever moves the lock link to the locked position. The lock further includes an override member connected for rotation with the lock lever cam and rotatable between an actuatable range wherein the inside door release lever is engageable with the override member to move the lock lever cam to the unlocking range, and a non-actuatable range wherein the inside door release lever is operatively disconnected from the override member. The lock is positionable in an unlocked state wherein the lock link is in the unlocked position, a locked state wherein the lock link is in the locked position, the lock lever cam is in the locking range and the override member is in the actuatable range, and an additional locked state wherein the lock link is in the locked position, the lock lever cam is in the locking range and the override member is in the non-actuatable range.

In another aspect, the invention is directed to a closure latch for a vehicle door. The closure latch includes a ratchet movable between an open position and a closed position, an electrical release actuator, an inside door release lever operatively connected to the pawl, and a lock mechanism including a first "lock" position wherein the release lever is operatively disconnected from the pawl but can be connected by either moving the inside door release lever (double pull override) or by powering the actuator, a second "unlock" lever position wherein the lock lever operatively connects to the pawl, and the third "child lock" position wherein the release lever is operatively disconnected from the pawl and cannot be connected to it by moving the inside door release lever.

In yet another aspect, the invention is directed to a closure latch for a vehicle door, that provides electric actuation to open the ratchet, and that provides a lock with at least two lock states including a first lock state wherein the lock is unlocked and at least a second lock state selected from the group consisting of: a locked state with a double pull override feature; a child-locked state; and a double-locked state.

In yet another aspect, the invention is directed to a closure latch with a common release lever for releasing the pawl and ratchet, and a power release actuator for moving the common release lever. Optionally the outside door handle is operatively connected to the common release lever through the power release actuator. Optionally the inside door handle is mechanically operatively connected to the common release lever. Instead of being mechanically operatively connected to the common release lever, the inside door handle may instead be operatively connected to the common release lever through the power release actuator.

BRIEF DESCRIPTION OF THE DRAWINGS

The present invention will now be described by way of example only with reference to the attached drawings, in which.

DETAILED DESCRIPTION OF THE INVENTION

Figure 1:
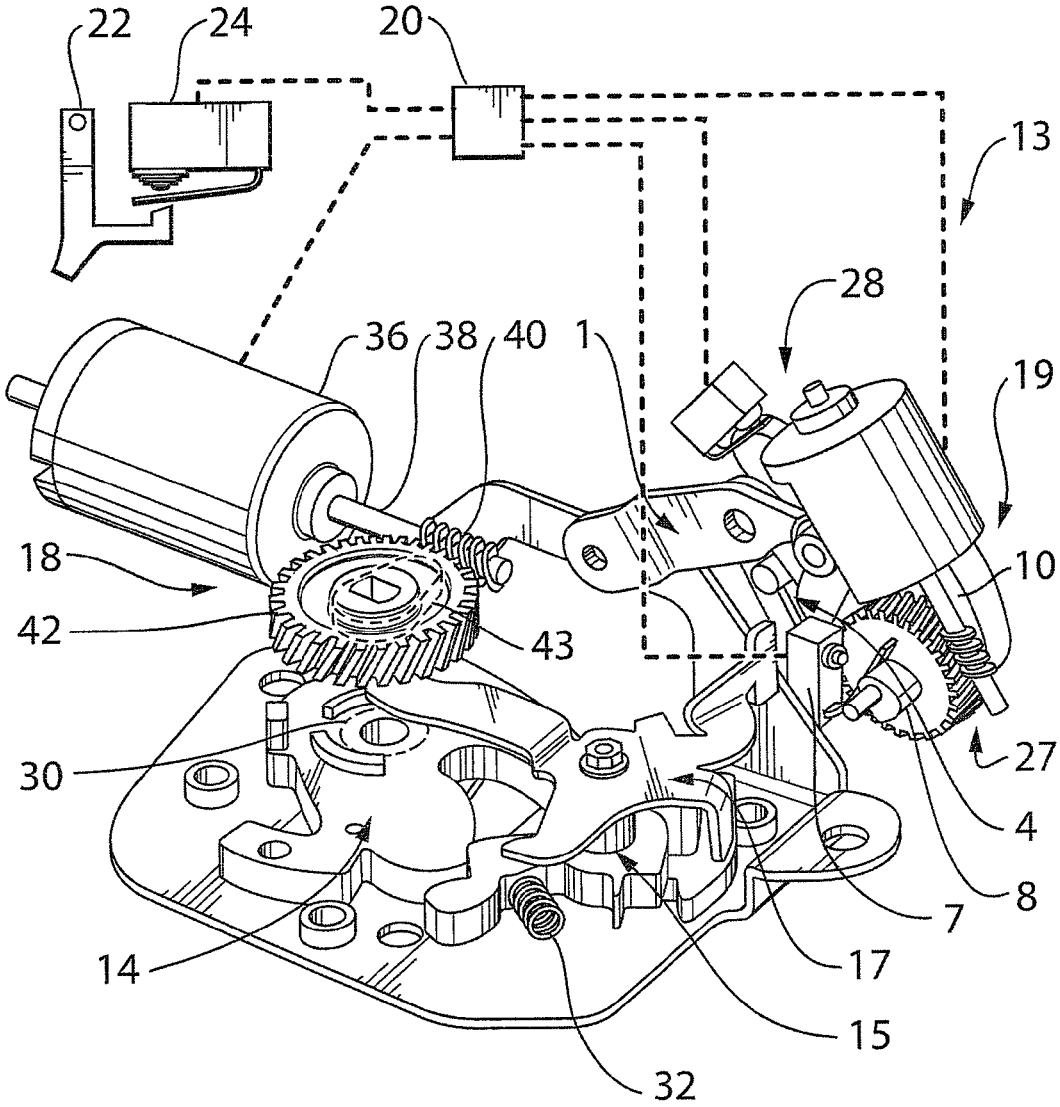
FIG. 1 is an elevation view of a closure latch in accordance with an embodiment of the present invention.

Reference is made to FIG. 1, which shows a closure latch 13 for a door (not shown) of a vehicle (not shown), in accordance with an embodiment of the present invention. The closure latch 13 includes a ratchet 14, a pawl 15, a common release lever 17, an inside door release lever 1, a power release actuator 18 and a lock 27, which includes a lock mechanism 28 and a lock actuator 19. The ratchet 14 is movable between a closed position (FIG. 1) wherein the ratchet 14 retains a striker (not shown) mounted on the body (not shown) of the vehicle (not shown), and an open position (not shown) wherein the ratchet 14 is unengaged with the striker. A ratchet biasing member 30, such as a suitable spring, may be provided to bias the ratchet 14 towards the open position.

The pawl 15 is movable between a ratchet locking position (FIG. 1) wherein the pawl 15 holds the ratchet 14 in the closed position, and a ratchet release position (not shown) wherein the pawl 15 permits the ratchet 14 to be in its open position. A pawl biasing member 32, such as a suitable spring, may be provided to bias the pawl 15 towards the ratchet locking position.

The common release lever 17 is operatively connected to the pawl 15 and is movable between a pawl release position wherein the common release lever 17 moves the pawl 15 to the ratchet release position, and a home position (FIG. 1) wherein the common release lever 17 permits the pawl 15 to be in the ratchet locking position.

A release lever biasing member 34, such as a suitable spring, may be provided to bias the common release lever 17 to the home position.

The common release lever 17 may be moved to the pawl release position by several components, such as, for example, by the power release actuator 18, by the inside door release lever 1.

The power release actuator 18 includes a power release actuator motor 36 having a power release actuator motor output shaft 38, a power release worm gear 40 mounted on the output shaft 38, and a power release driven gear 42. A power release cam 43 is connected for rotation with the driven gear 42 and is rotatable between a pawl release range of positions and a pawl non-release range of positions. In FIG. 1, the power release cam 43 is a position that is within the pawl non-release range. The driven gear 42 is driven by the worm gear 40 and in turn drives the cam 43 which drives the pivoting of the common release lever 17 between the home and pawl release positions.

The power release actuator 18 may be used as part of a passive entry feature. When a person approaches the vehicle with an electronic key fob and opens the outside door handle 22, the vehicle senses both the presence of the key fob and that the door handle has been actuated (eg. via communication between a switch 24 and an electronic control unit (ECU) shown at 20 that at least partially controls the operation of the closure latch 13). In turn, the ECU 20 actuates the power release actuator 18 to open the closure latch 13, so as to open the vehicle door.

Figure 2A:
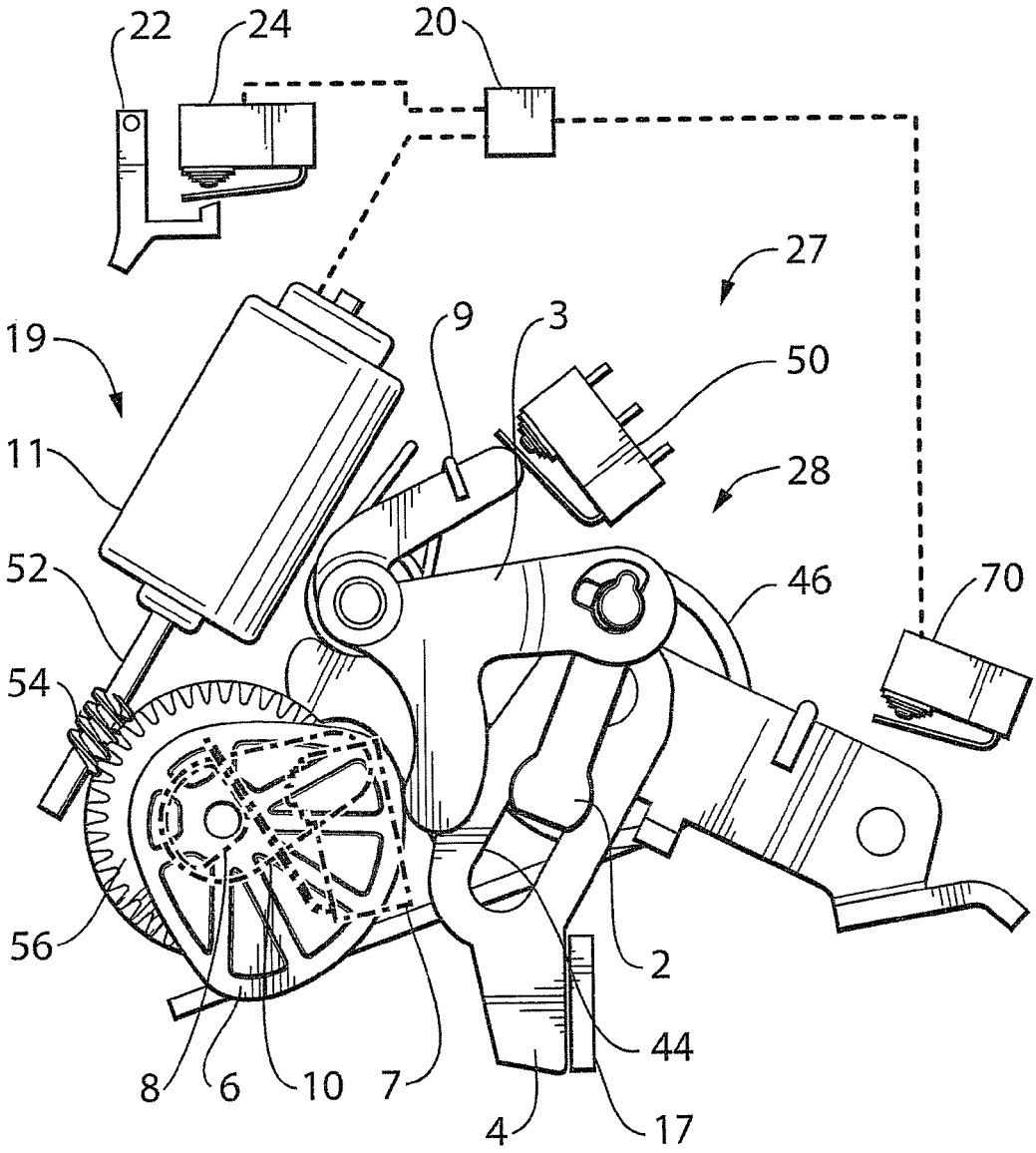
FIG. 2*a* is a plan view of a lock that is part of the closure latch shown in FIG. 1, in a locked state.

The lock 27 controls the operative connection between the inside door release lever 1 and the common release lever 17. Referring to FIG. 2*a*, the lock mechanism 28 includes an auxiliary release lever 4, a lock link 2 and a lock lever 3. The auxiliary release lever 4 is operatively connected to the common release lever 17, and is movable between a home position (shown in FIG. 2*a*) wherein the auxiliary release lever 4 permits the common release lever 17 to be in the home position, and a pawl release position wherein the auxiliary release lever 4 moves the common release lever 17 to the pawl release position.

The lock link 2 is slidable within a slot 44 in the auxiliary release lever 4 and controls the connection between the inside door release lever 1 and the auxiliary release lever 4. The lock link 2 is movable between a locked position (FIG. 2*a*) and an unlocked position (FIG. 2*c*). When the lock link 2 is in the unlocked position, it is positioned in the path of the inside door release lever 1 from a home position (FIG. 2*a*) to an actuated position (not shown). As a result, when the inside door release lever 1 is moved from the home position to the actuated position, it engages and moves the lock link 2 and as a result it causes the auxiliary release lever 4 to rotate from its home position to its pawl release position (not shown). When the lock link 2 is in the locked position (FIG. 2*a*), it is not in the path of the inside door release lever 1. As a result, movement of the inside door release lever 1 from its home position to the actuated position does not result in any corresponding movement of the auxiliary release lever 4 away from its home position.

The lock lever 3 is operatively connected to the lock link 2 and is movable between a locked position (FIG. 2*a*) wherein the lock lever 3 positions the lock link 2 in its locked position, and an unlocked position (FIG. 2*c*) wherein the lock lever 3 positions the lock link 2 in its unlocked position.

An inside door release lever biasing member 46, such as a suitable spring, may be provided to bias the inside door release lever 1 to the home position. A lock lever biasing member 9, such as a suitable spring, may be provided to bias the lock lever 3 to the unlocked position.

A lock lever state switch 50 can be used to indicate to the ECU 20, the state of the lock lever 3 (ie. whether it is in the locked or unlocked position). It will be understood that the lock lever state switch 50 is an alternative switch that can be provided instead of the switch 7 and switch cam 8. In other words, if the switch 50 is provided, the switch 7 and cam 8 may be omitted. Alternatively if the switch 7 and cam 8 are provided, the switch 50 may be omitted.

The lock actuator 19 controls the position and operation of the lock mechanism 28. The lock actuator 19 includes a lock actuator motor 11 which has a lock actuator motor output shaft 52 with a lock actuator worm gear 54 thereon, a lock actuator driven gear 56, a lock lever cam 6, an override member 10, a lock lever cam state switch cam 8 and a lock lever cam state switch 7. The lock lever cam 6, the inside door release lever cam 10 and the lock lever cam state switch cam 8 are all fixed together and rotatable with the driven gear 56. The override member 10, the switch cam 8 and the switch 7 are shown at least in outline in FIGS. 2*a*-2*d* even though they are obstructed from view by lock lever cam 6. These components are shown at least partially in FIG. 1, however.

The lock lever cam 6 is operatively connected to the lock lever 3, and is rotatable between a locking range of positions and an unlocking range of positions. When in a position that is within the locking range of positions (examples of which are shown in FIGS. 2*a* and 2*d*), the lock lever cam 6 holds the lock lever 3 in its locked position. When in a position that is within the unlocking range of positions (an example of which is shown in FIG. 2*c*), the lock lever cam 6 permits the lock lever 3 to move to the unlocked position.

The lock lever cam state switch cam 8 is movable between an unlocking range of positions (an example of which is shown in FIG. 2*c*), and a locking range of positions (an example of which is shown in FIG. 2*a*). Movement of the lock lever cam state switch cam 8 between the unlocking and locking ranges changes the state of the lock lever cam state switch 7. For example, the switch 7 may be open when the lock lever cam state switch cam 8 is in the locking range and may be closed when the lock lever cam state switch cam 8 is in the unlocking range, or vice versa. The state of the lock lever cam state switch 7 may be used by the ECU 20 to determine whether or not to permit the outside door handle 22 to be operatively connected to the common release lever 17

(via the power release actuator 18 shown in FIG. 1). It will be noted that it is alternatively possible for the operation of the switch 7 to be reversed and for the profile of the lock lever cam state switch cam 8 to be reversed, such that opening of the switch 7 would indicate to the ECU 20 that the lock 27 was unlocked, and closing of the switch 7 would indicate to the ECU 20 that the lock 27 was locked.

The override member 10 is movable between an actuatable range of positions (an example of which is shown in FIG. 2*a*), and a non-actuatable range of positions (examples of which are shown in FIGS. 2*c* and 2*d*). The operation of the override member 10 is described further below.

Rotation of the lock actuator motor 11 drives the rotation of the driven gear 56 (through the worm gear 54) and therefore drives the movement of the lock lever cam 6, the lock lever cam state switch cam 8 and the inside door release lever cam 10.

For a rear door application, the lock 27 may have three lock states: locked (FIG. 2*a*), unlocked (FIG. 2*c*), and child-locked (FIG. 2*d*).

Referring to FIG. 2*c*, when the lock 27 is in the unlocked state, the lock lever cam 6 is within the unlocking range and as a result, the lock lever 3 and lock link 2 are in their unlocked positions. As a result, the inside door release lever 1 is operatively connected to the common release lever 17 (and therefore to the pawl 15 shown in FIG. 1) through the lock link 2 and the auxiliary release lever 4. Thus, actuation of the inside door release lever 1 to the actuated position results in the actuation of common release lever 17 and thus movement of the pawl 15 (FIG. 1) to the ratchet release position (not shown), thereby releasing the ratchet 14 (FIG. 1). Additionally, the lock lever cam state switch cam 8 is in the unlocking range so as to indicate to the ECU 20 to consider the outside door handle 22 as unlocked. As a result, if the outside door handle 22 were pulled by a person outside the vehicle even if they do not possess the electronic key fob or a key, the power release actuator 18 (FIG. 1) actuates the common release lever 17 so as to open the vehicle door.

The lock 27 shown in FIGS. 2*a*-2*d* includes a double pull override feature that permits the inside door release lever 1 to open the vehicle door even if the lock 27 is in the locked position. Referring to FIG. 2*a*, when the lock 27 in the locked position the lock lever cam 6 is in the locking range and thus holds the lock lever 3 in the locked position against the urging of the lock lever biasing member 9. Furthermore, the lock lever cam state switch cam 8 is in the locking range and as a result, the lock lever cam state switch 7 indicates to the ECU 20 that the lock 27 is locked so that the ECU 20 operatively disconnects the outside door handle 22 from the common release lever 17. Furthermore, the override member 10 is in the actuatable range.

When the inside door release lever 1 is actuated (ie. moved to the actuated position) while the lock 27 is in the locked position (see FIG. 2*b*), the inside door release lever 1 does not move the auxiliary release lever 4 to the pawl release position. The movement of the inside door release lever 1 does, however, drive the override member 10 to move from a first position which is an actuatable position, to a second position which is in the non-actuatable range. Because the lock lever cam 6, the lock lever cam state switch cam 8 and the override member 10 are all connected together, the movement of the override member 10 to the second position (FIG. 2*b*) results in movement of the lock lever cam 6 to a position within the unlocking range and results in movement of the lock lever cam state switch cam 8 to a position within the unlocking range. The movement of the lock lever cam state switch cam 8 to within the unlocking range closes the lock lever cam state switch 7 so as to signal to the ECU 20 to permit operative control between the outside door handle 22 and the common release lever 17.

While the inside door release lever 1 is still actuated, a lock link keeper surface 58 optionally provided thereon holds the lock link 2 in the locked position. As a result, the lock lever 3 remains in the locked position even though the lock lever cam 6 no longer obstructs its movement to the unlocked position. The respective states of the lock lever cam state switch 7 and the lock lever state switch 50 can be used to indicate to the ECU 20 that the lock 27 is in an 'override' state.

When the inside door release lever 1 is released from the actuated position and moves back to its home position (see FIG. 2*c*), the keeper surface 58 moves out of the way of the lock link 2, and so the lock link 2 and the lock lever 3 move to their unlocked positions under the urging of the lock lever biasing member 9 (FIG. 2*c*). As a result, the lock 27 is in the unlocked state. Thus, when the lock 27 was in the locked state, actuation and return to the home position of the inside door release lever 1 has moved the lock 27 to the unlocked state shown in FIG. 2*c*, wherein the inside door release lever 1 is operatively connected to the common release lever 17 through the lock link 2 and the auxiliary release lever 4. As a result, a second actuation of the inside door release lever 1 actuates the common release lever 17 so as to release the pawl 15 (FIG. 1) and open the vehicle door (not shown).

When the lock 27 is in the child-locked state, shown in FIG. 2*d*, the lock lever cam 6 is in the locking range, and as a result the lock link 2 and lock lever 3 are in their locked positions. Furthermore, the override member 10 is in a third position, which is in the non-actuatable range. As a result, the inside door release lever 1 is prevented from overriding the lock 27 and opening the vehicle door regardless of how many times it is actuated. Furthermore, the lock lever cam state switch cam 8 may be in the locking range, thereby resulting in the operative disconnection between the outside door handle 22 and the common release lever 17.

The lock 27 may be positionable in the unlocked, locked and child-locked positions by the lock actuator 19. More specifically, to move the lock 27 from the locked state (FIG. 2*a*) to the unlocked state (FIG. 2*c*) the lock actuation motor 11 may be actuated to rotate the driven gear 56 in a first direction (clockwise in the view shown in FIG. 2*a*) until the ECU 20 senses that the lock lever cam state switch cam 8 has moved to the unlocking range based on the state of the switch 7 and that the lock lever cam 6 has moved to the unlocking range based on the state of the switch 50. To move the lock 27 from the unlocked state (FIG. 2*c*) to the child-locked state (FIG. 2*d*) the lock actuation motor 11 may be actuated to rotate the driven gear 56 in the first direction (clockwise in the view shown in FIG. 2*c*) until the lock actuation motor 11 stalls as a result of engagement with a component connected to the driven gear 56 with a corresponding limit surface. To move the lock 27 from the locked state (FIG. 2*a*) to the child-locked state (FIG. 2*d*) the lock actuation motor 11 may be actuated to rotate the driven gear 56 in the first direction (clockwise in the view shown in FIG. 2*a*) until the lock actuation motor 11 stalls as a result of engagement with a component connected to the driven gear 56 with a corresponding limit surface.

To move the lock 27 from the child-locked state (FIG. 2*d*) to the unlocked state (FIG. 2*c*) the lock actuation motor 11 may be actuated to rotate the driven gear 56 in a second direction (counter-clockwise in the view shown in FIG. 2*d*) until the ECU 20 senses that the lock lever cam state switch cam 8 has moved to the unlocking range based on the state of the switch 7, and that the lock lever cam 6 has moved to the unlocking range based on the state of the switch 50. To move the lock 27 from the unlocked state (FIG. 2*c*) to the locked state (FIG. 2*a*) the lock actuation motor 11 may be actuated to rotate the driven gear 56 in the second direction (counter-clockwise in the view shown in FIG. 2*c*) until the lock actuation motor 11 stalls as a result of engagement with a component connected to the driven gear 56 with a corresponding limit surface. To move the lock 27 from the child-locked state (FIG. 2*d*) to the locked state (FIG. 2*a*) the lock actuation motor 11 may be actuated to rotate the driven gear 56 in the second direction (counter-clockwise in the view shown in FIG. 2*d*) until the lock actuation motor 11 stalls as a result of engagement with a component connected to the driven gear 56 with a corresponding limit surface.

During the aforementioned movements of the lock components, the lock state can be indicated to the ECU 20 by state of the lock lever cam state switch 7 and additionally in some cases by the most recent command issued by the ECU 20 to the lock actuation motor 11. More specifically, if the switch 7 indicates a locked state, and the most recent command by the ECU 20 was to rotate the motor 11 in the first direction, then the lock 27 is in the child-locked state. If the switch 7 indicates a locked state and the most recent command by the ECU 20 was to rotate the motor 11 in the second direction, then the lock 27 is in the locked state. If the switch 7 is indicates an unlocked state, then the lock 27 is in the unlocked state regardless of the most recent command issued by the ECU 20 to the motor 11. It will be noted that the lock state of the lock 27 could alternatively be determined by the state of the lock lever state switch 50 instead of the state of the switch 7.

Figure 2B:
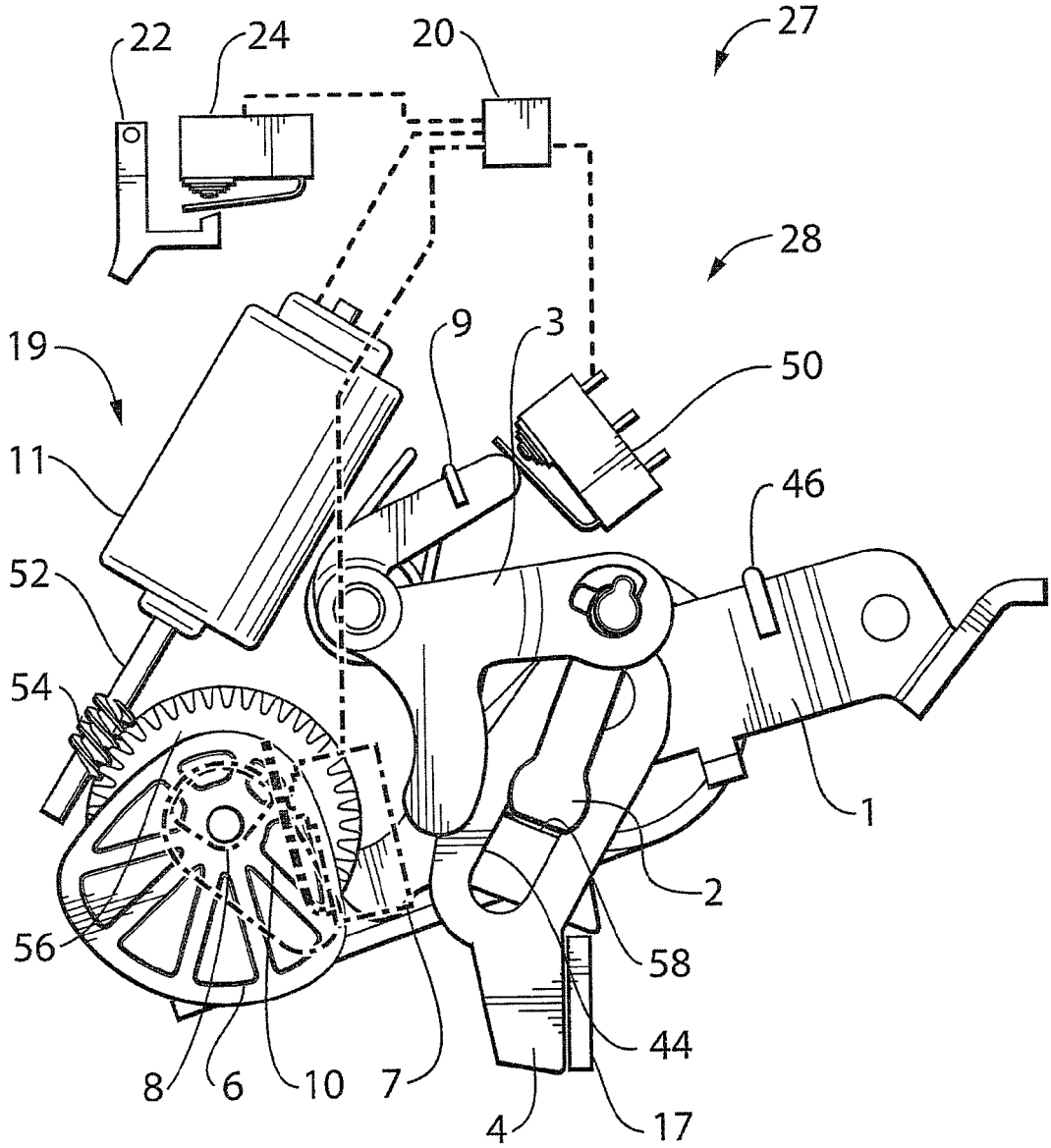
FIG. 2*b* is a plan view of the lock shown in FIG. 2*a*, in an override state.
Figure 2C:
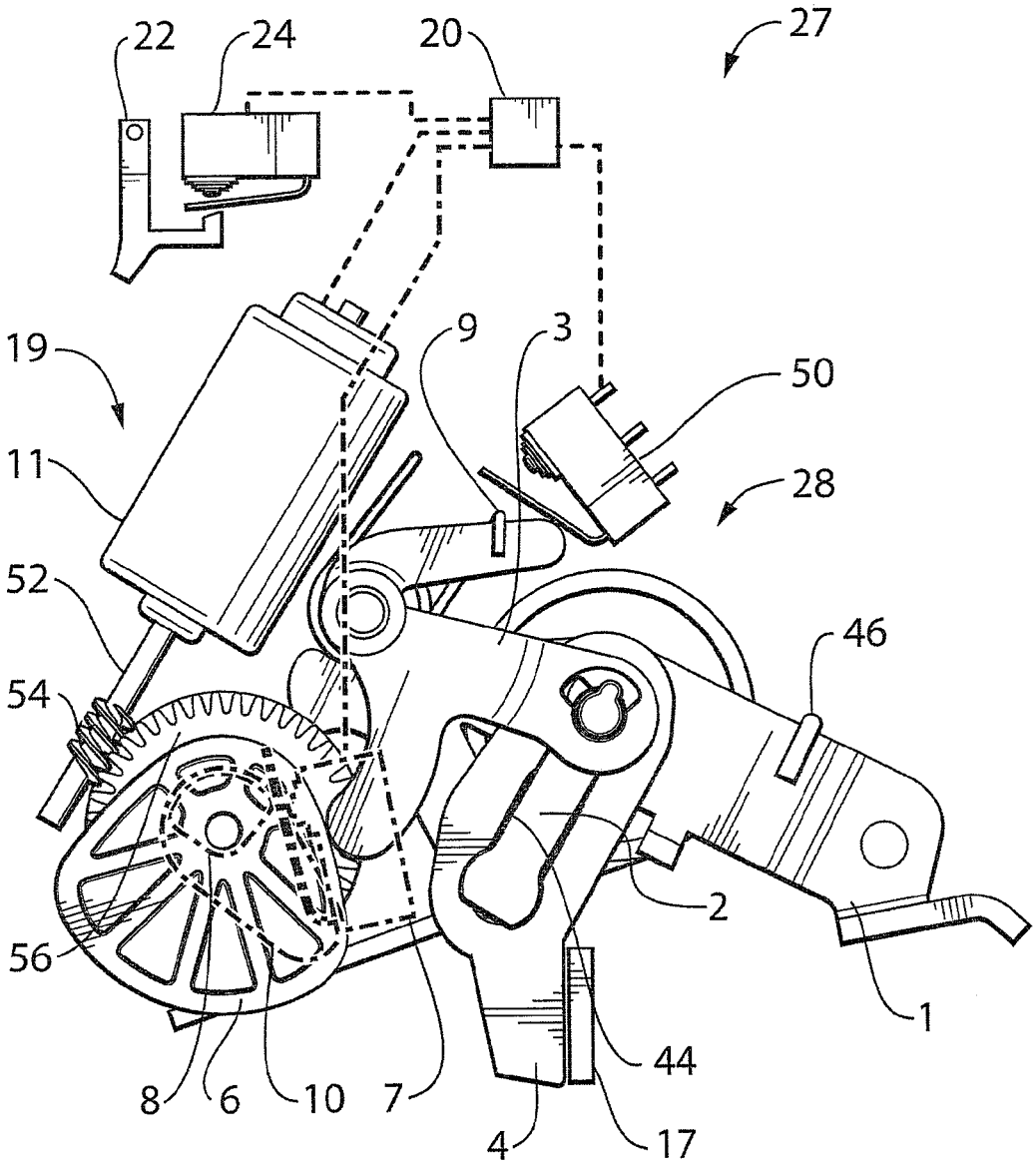
FIG. 2*c* is a plan view of the lock shown in FIG. 2*a*, in an unlocked state.
Figure 2D:
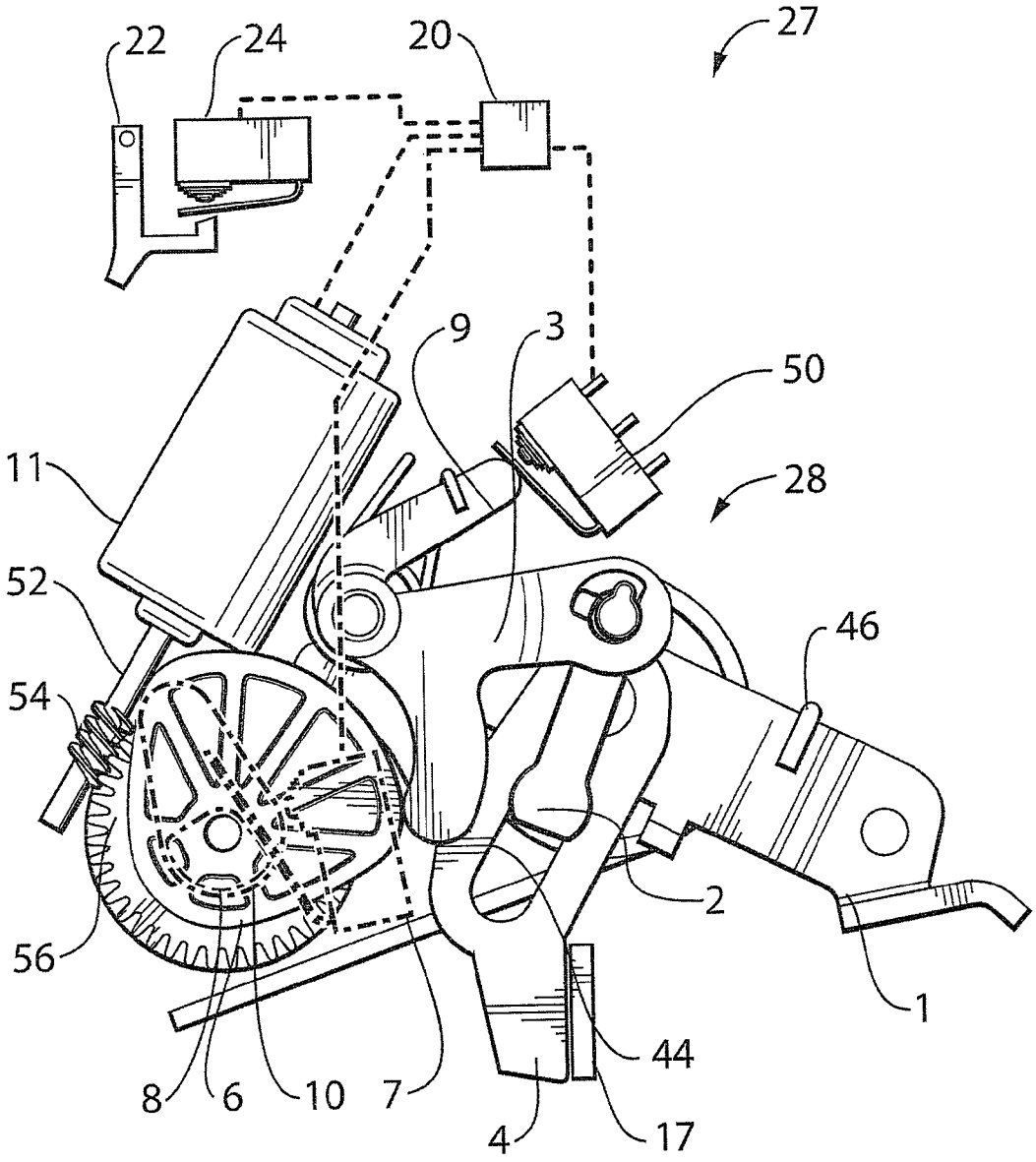
FIG. 2*d* is a plan view of the lock shown in FIG. 2*a*, in an child-locked state.

The lock 27 shown in FIGS. 2*a*-2*d* includes a 'panic' feature, which permits the lock state to be changed from the child-locked state (FIG. 2*d*) to the unlocked state (FIG. 2*c*), while the inside door release lever 1 is in its actuated position (FIG. 2*b*). Because the keeper surface 58 on the inside door release lever 1 keeps the lock lever 3 in the locked position, the lock lever 3 does not obstruct the movement of the lock lever cam 6 counter-clockwise to its unlocking range. As a result, when the inside door release lever 1 is released and moves back to its home position, the lock lever 3 can move to its unlocked position, and the lock 27 at that point will be in the unlocked state. Thus, the lock 27 permits the closure latch 13 to receive and act upon an instruction to unlock, even when a vehicle occupant has actuated the inside door release lever 1 and hold the release lever 1 in the actuated position.

With reference to 2*a*, it is optionally possible to provide an additional double lock feature for the closure latch 13. Thus, the lock 27 (and therefore the closure latch 13) would have a child-locked state, an unlocked state and a locked state and a double-locked state. In the child-locked state, the lock 27 does not permit the inside door release lever 1 to be able to open the closure latch 13, but it may permit the inside door release lever 1 to unlock the outside door handle 22, so that the outside door handle 22 can subsequently be used to open the closure latch 13. To achieve this, an inside door release lever state switch shown at 70 may be provided for indicating to the ECU 20 the state of the inside door release lever (ie. for indicating to the ECU 20 whether the inside door release lever 1 is in the home position or the actuated position). When the inside door release lever 1 is actuated, the ECU 20 can sense it and if the lock 27 is in the child-locked state, the ECU 20 can unlock the outside door handle 22. When the inside door release lever 1 is actuated while the lock 27 is in the double-locked state, the ECU 20 would not unlock the lock link 2 or the outside door handle 22.

Instead of the motor 11 being capable of turning the driven gear 56 to a selected position associated with the child-locked state of the lock 27, it is alternatively possible for movement of the lock 27 into and out of the child-locked state to be manually controlled, (eg. via a child lock mechanism that includes a lever that protrudes from the vehicle door (not shown)). In such an embodiment, the child lock mechanism may include a separate child lock cam that engages a suitable part of the lock lever to control whether it moves to the unlocked position. The child lock cam may be rotatable between a locking range of positions and a non-locking range of positions.

Because the child locking capability is provided from the child lock mechanism, the ECU 20 can operate the motor 11 between two positions instead of three positions. The two positions would correspond to an unlocked state of the outside door hand lock 27 and, for example, a locked state.

Figure 4:
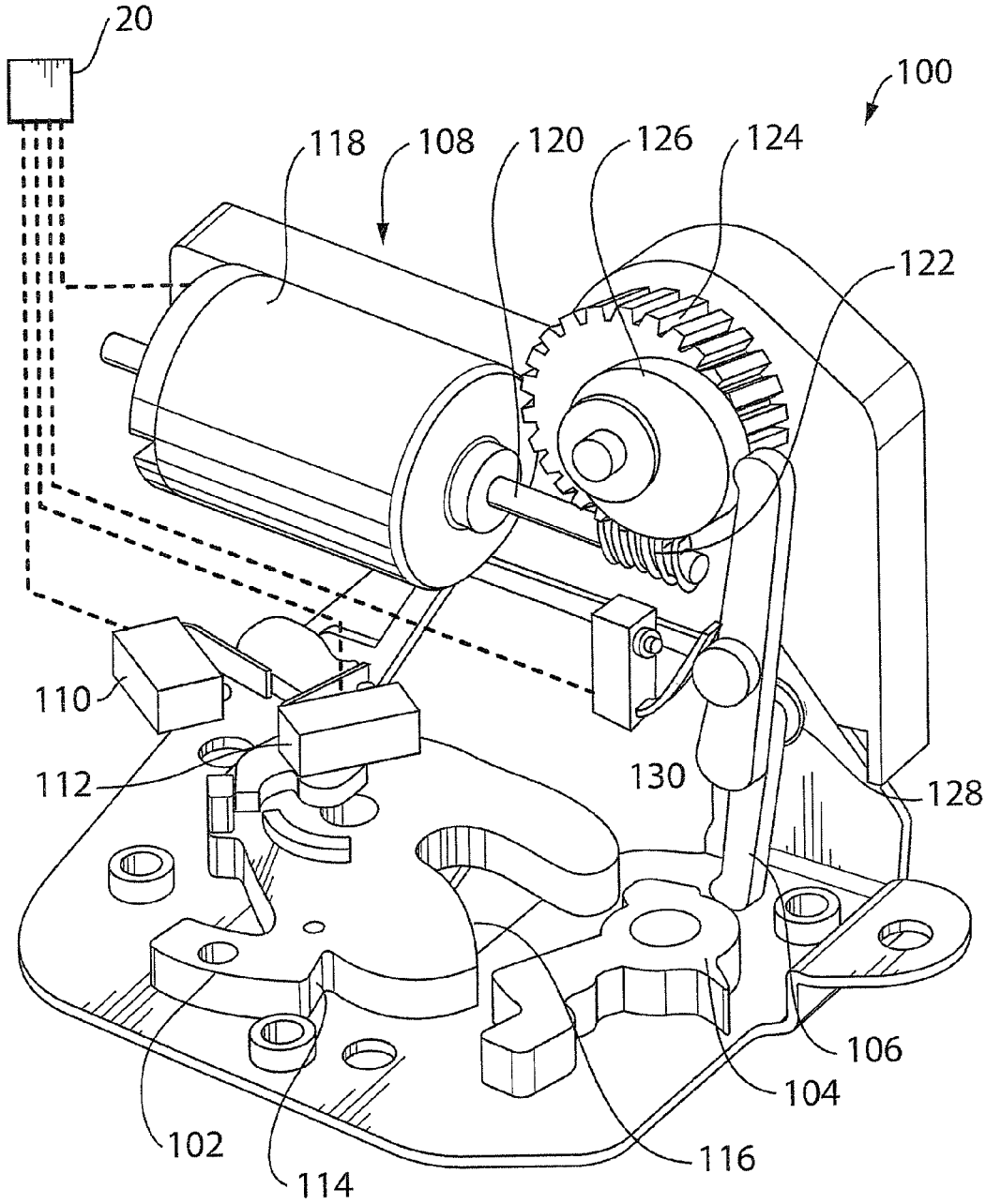
FIG. 4 is a perspective view of a closure latch in accordance with yet another embodiment of the present invention.

Reference is made to FIG. 4, which shows a closure latch 100 in accordance with another embodiment of the present invention. The closure latch 100 includes a ratchet 102, a pawl 104 (which may be similar to the ratchet 14 and pawl 15 in FIG. 1 and which may be biased to the open position for the ratchet and to the ratchet locking position for the pawl by suitable biasing members), a common release lever 106 and a power release actuator 108. The ratchet 102 may have structure thereon for tripping two switches, shown at 110 and 112. The first switch 110 may be a door-ajar indicator switch, which is positioned to indicate a condition where the ratchet 102 is in the secondary position (ie. where the pawl 104 holds the secondary locking surface, shown at 114 of the ratchet 102 instead of holding the primary locking surface 116). The second switch 112 may be used to indicate that the ratchet 102 is open (thereby indicating that the vehicle door is open).

The power release actuator 108 may include a power release actuator motor 118 with an output shaft 120 with a worm gear 122 thereon, which drives a driven gear 124. The driven gear 124 has a release lever actuation cam 126 connected thereto which pivots the common release lever 106 from a home position to a pawl release position (FIG. 4). A release lever biasing member 128 may be provided to bias the common release lever 106 towards its home position.

When the power release actuator 108 is used to release the pawl 104 to open the vehicle door, the ECU 20 may run the motor 118 until the ECU 20 receives a signal that the vehicle door is open (from switch 112), or until a selected time period has elapsed, indicating that the vehicle door is stuck (eg. from snow or ice buildup on the vehicle). Upon receiving a signal from the door state switch that the vehicle door is open, the ECU 20 can send a signal to the motor 118 to reset the ratchet 102 and pawl 104 so that the pawl 104 is ready to lock the ratchet 102 when the vehicle door is closed.

The ECU 20 may receive signals from an inside door handle state switch (not shown in FIG. 4) and from the outside door handle state switch 24 which indicate to the ECU 20 whether either of the inside door handle (not shown) and the outside door handle 22 is in its home position or is actuated. The ECU 20 can provide any of several lock states including child-locked, unlocked, double-locked and locked, by selectively acting upon or ignoring actuation signals from the inside door handle and/or the outside door handle 22. These lock states may be logical states of the ECU 20. Functions such as double-pull override can be provided, whereby the ECU 20 unlocks the inside door handle upon a first actuation of the inside door handle (while the latch is locked).

A common release lever state switch 130 may be provided that senses the position of the common release lever 106. The state switch 130 can be used to indicate to the ECU 20 when the common release lever 106 has reached the actuated position.

The closure latch 13 described above has been described in the context of being used in a rear door of a vehicle. The closure latch 13 may also be used as shown in FIGS. 1 and 2*a*-2*d* in a front door of a vehicle having three lock states, including a locked state, an unlocked state and a double-locked state (instead of the child-locked state used in a rear door application). These three lock states may be provided by the similar structure that provided the three lock states (locked, unlocked and child-locked) for the closure latch 13 shown in FIGS. 1 and 2*a*-2*d*. One difference is that, when the lock 27 is in the double-locked state, the ECU 20 would not unlock the outside door handle 22 when the inside door release lever 1 is actuated, whereas it may be programmed to as described above, when in the child-locked state in a rear door application.

Figure 3:
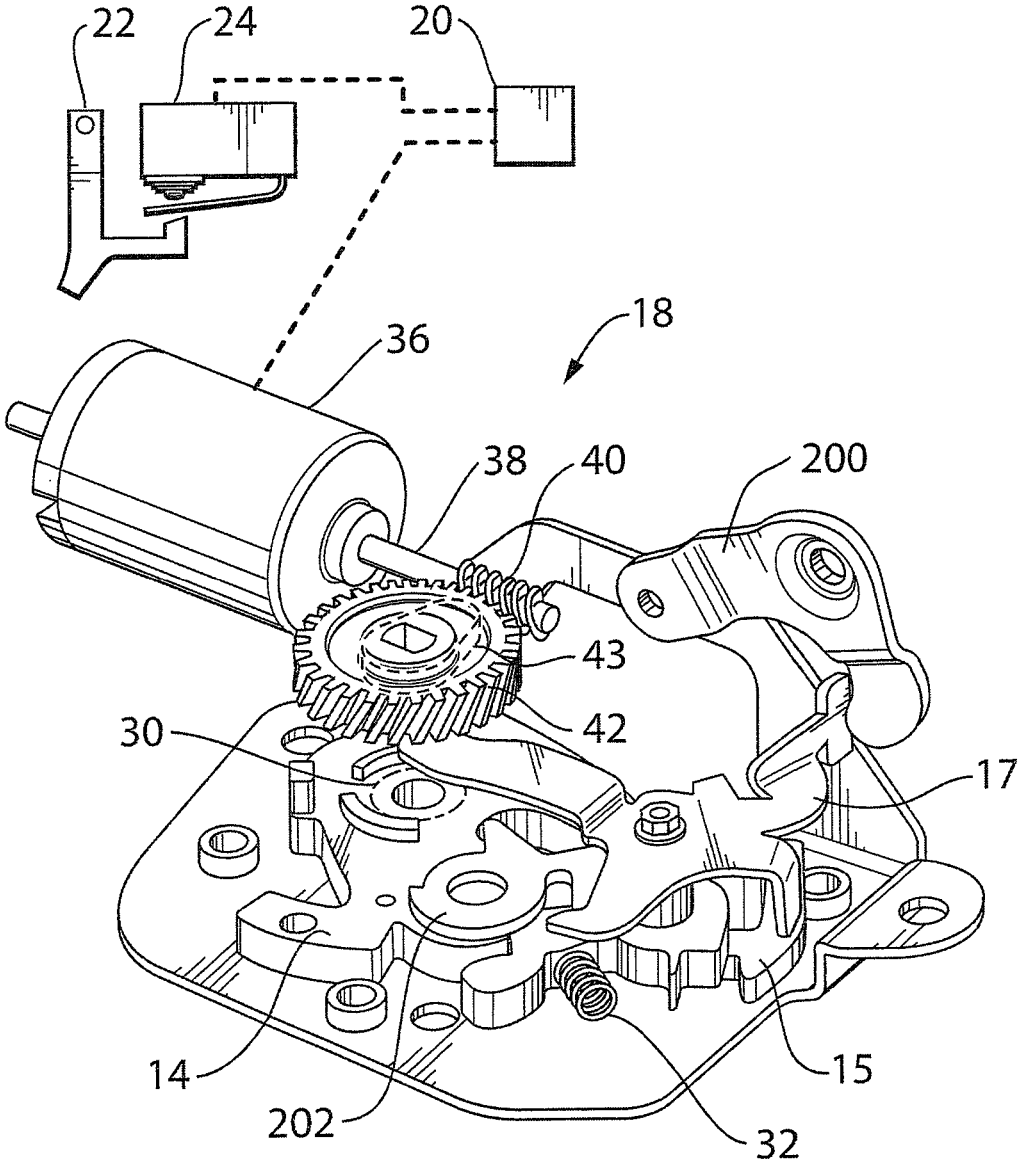
FIG. 3 is a perspective view of a closure latch in accordance with another embodiment of the present invention.

Another example of a configuration for the closure latch 13 for a front door application is shown in FIG. 3. The closure latch 13 in FIG. 3 may include a lock (not shown) that has a locked state and an unlocked state, and that does not have a child-locked state. In the locked state, the lock disables the outside door handle 22. In the unlocked state, the lock permits actuation of the common release lever 17 by the outside door handle 22 through the power release actuator 18. The closure latch 13 in FIG. 3 may lack a double-pull override feature, permitting instead the direct actuation of the common release lever 17 by the inside door release lever, shown at 200, without regard as to whether or not the lock (not shown) is in the locked state. Optionally, the vehicle door (not shown) may include a key lock, which includes a key cylinder that is rotated using a key. In such an instance, an outside door release lever 202 may be provided, which is mechanically operatively connected to the common release lever 17 and which is itself mechanically actuated by rotation of the key cylinder.

The closure latch 13 can be configured to provide two lock states instead of three. For example, in a front door application, the closure latch may have a double-locked state and an unlocked state. In such a configuration, the override member 10 is not needed and may be omitted, because in the double-locked state, the inside door release lever 1 cannot be used to override the lock. Furthermore, the closure latch 13 may be configured so that the unlocked state represents a limit of travel for the driven gear 56 instead of corresponding to an intermediate position between two travel limits. As a result, the motor 11 can be rotated in a first direction until it stalls to move the lock to the double-locked state, and can be rotated in a second direction until it stalls to move the lock to the unlocked state.

In yet another variation, the closure latch 13 may be used in a front door application with two lock states: locked and unlocked, wherein the double pull override feature is provided as a way of moving the latch 13 out of the locked state. In this variation, the override member 10 is provided and can is engageable by the inside door release lever 1 to bring the latch 13 to the unlocked state, so that a subsequent actuation of the inside door release lever 1 will open the latch 13. The unlocked state can, in this variation, be at one limit of travel for the driven gear 56, while the locked state can be at the other limit of travel for the driven gear 56, so that when the motor 11 is used to change the lock state, it is moved in one direction or the other until the motor 11 stalls.

While the above description constitutes a plurality of embodiments of the present invention, it will be appreciated that the present invention is susceptible to further modification and change without departing from the fair meaning of the accompanying claims.

The invention claimed is:

1. A closure latch for use in holding a vehicle door closed against a vehicle body, the closure latch comprising:

a ratchet mountable to one of the vehicle door and the vehicle body, movable between an open position and a closed position, wherein in the open position the ratchet disengages from a striker that is mountable to the other of the vehicle door and the vehicle body, and wherein in the closed position the ratchet is positioned to retain the striker, wherein the ratchet is biased towards the open position;

a pawl movable between a ratchet locking position wherein the pawl holds the ratchet in the closed position and a ratchet release position wherein the pawl permits the ratchet to move to the open position, and wherein the pawl is biased towards the ratchet locking position;

an inside door release lever operatively connectable to the pawl; and a lock including:

a lock link movable between an unlocked position wherein the lock link operatively connects the inside door release lever to the pawl, and a locked position wherein the lock link operatively disconnects the inside door release lever from the pawl, wherein the lock link is biased towards the unlocked position;

a first cam operatively connected to the lock link, wherein the first cam is rotatable between an unlocking range wherein the first cam permits the lock link to move to the unlocked position, and a locking range wherein the first cam moves the lock link to the locked position; and an override member connected for rotation with the first cam and rotatable between an actuatable range and a non-actuable range, wherein when the override member is in the actuable range the inside door release lever is operatively connected to the override member such that the inside door release lever is movable to drive the override member to a selected position which brings the first cam to the unlocking range, and when the override member is in the non-actuatable range the inside door release lever is operatively disconnected from the override member, wherein the lock is positionable in an unlocked state in which the lock link is in the unlocked position, wherein the lock is further positionable in a locked state in which the lock link is in the locked position, the first cam is in the locking range and the override member is in the actuatable range, and wherein the lock is further positionable in an additional locked state in which the lock link is in the locked position, the first cam is in the locking range and the override member is in the non-actuatable range.

2. A closure latch as claimed in claim 1, further comprising:

a driven gear connected for rotation with the first cam and the override member; and a lock actuation motor that controls the position of the driven gear.

3. A closure latch as claimed in claim 1, further comprising a switch having a locked state and an unlocked state, wherein the locked state is indicative that the first cam is in the locking range so as to indicate to an electronic control unit to operatively disconnect an outside door handle from the pawl, and wherein the unlocked state is indicative that the first cam is in the unlocking range so as to indicate to the electronic control unit to operatively connect an outside door handle to the pawl.

4. A closure latch as claimed in claim 3, further comprising a state switch cam that is rotatable with the first cam and the override member, and is positionable between an unlocking range wherein the state switch cam causes the switch to be in an unlocked state, and a locking range wherein the state switch cam causes the switch to be in a locked state.

5. A closure latch as claimed in claim 3, wherein the outside door handle is operatively connectable to the pawl via a power release actuator motor, that is controllable by the electronic control unit to drive movement of a common release lever, wherein the common release lever is operatively connected to the pawl, wherein the additional locked state is a child-locked state, and wherein the lock further includes an inside door release lever state switch that is configured to indicate to the electronic control unit whether or not the inside door release lever is actuated, wherein the electronic control unit is configured to sense actuation of the outside door handle and to drive movement of the common release lever using the power release actuator motor to bring the pawl to the ratchet release position upon said actuation of the outside door handle if the lock is in the child-locked state and the inside door release lever is actuated.

6. A closure latch as claimed in claim 1, further comprising a lock lever operatively connected to the lock link and that is rotatable between an unlocked position wherein the lock lever positions the lock link in the unlocked position and a locked position wherein the lock lever positions the lock link in the locked position, wherein the lock lever is biased towards the unlocked position, wherein the position of the lock lever is controlled by the first cam.

7. A closure latch as claimed in claim 1, further comprising a common release lever that is operatively connected to the pawl, and a power release actuator that is operatively connected to the common release lever, wherein the inside door release lever is operatively connected to the pawl through the common release lever when the lock link is in the unlocked position.

8. A closure latch as claimed in claim 7, wherein the power release actuator includes a power release actuator motor that is controllable based at least in part by the state of the lock link.

9. A closure latch as claimed in claim 6, wherein at a selected point along a portion of the lock lever travel between the unlocked and locked positions the lock link disconnects the inside door release lever from the pawl.

10. A closure latch as claimed in claim 2, wherein the lock actuation motor is rotatable between a first position associated with the locked state of the lock wherein the first cam and override member are driven by the driven gear to the locking range and the actuatable range respectively, a second position associated with the unlocked state of the lock wherein the first cam is driven by the driven gear to the unlocking range, and a third position associated with the additional locked state of the lock, wherein the first cam and the override member are driven by the driven gear to the locking range and the non-actuatable range respectively.

* * * * *